US011702887B2

(12) United States Patent
Pyke et al.

(10) Patent No.: US 11,702,887 B2
(45) Date of Patent: Jul. 18, 2023

(54) SYSTEM, APPARATUS, AND METHOD TO PERFORM LEVELING FOR BOREHOLE DRILLS

(71) Applicant: Peck Tech Consulting Ltd., Montreal (CA)

(72) Inventors: Sandy Pyke, Saint-Constant (CA); Francois Gariepy, Saint-Colomban (CA)

(73) Assignee: Peck Tech Consulting Ltd., Montreal (CA)

( * ) Notice: Subject to any disclaimer, the term of this patent is extended or adjusted under 35 U.S.C. 154(b) by 342 days.

(21) Appl. No.: 16/925,417

(22) Filed: Jul. 10, 2020

(65) Prior Publication Data

US 2021/0010329 A1 Jan. 14, 2021

Related U.S. Application Data

(60) Provisional application No. 62/873,700, filed on Jul. 12, 2019.

(51) Int. Cl.

| | |
|---|---|
| ***E21B 7/02*** | (2006.01) |
| ***B66F 3/24*** | (2006.01) |
| ***B66F 3/46*** | (2006.01) |

(52) U.S. Cl.

CPC ..... *E21B 7/024* (2013.01); *B66F 3/24* (2013.01); *B66F 3/46* (2013.01); *E21B 7/025* (2013.01)

(58) Field of Classification Search

CPC .. E21B 7/024; E21B 7/025; B66F 3/24; B66F 3/46

See application file for complete search history.

(56) References Cited

U.S. PATENT DOCUMENTS

| | | | | | |
|---|---|---|---|---|---|
| 3,625,483 | A | * | 12/1971 | Stoner | B60S 9/12 254/423 |
| 4,142,710 | A | * | 3/1979 | Okuda | B66C 23/80 254/423 |
| 4,165,861 | A | * | 8/1979 | Hanser | B60S 9/12 254/423 |
| 4,679,489 | A | | 7/1987 | Jasinski et al. | |
| 4,777,798 | A | * | 10/1988 | Jacobson | F15B 11/22 91/1 |
| 5,065,844 | A | * | 11/1991 | Hon | B66B 9/04 91/171 |
| 5,143,386 | A | * | 9/1992 | Uriarte | B60S 9/02 180/41 |

(Continued)

FOREIGN PATENT DOCUMENTS

RU 2196893 C1 1/2003

*Primary Examiner* — Nicole Coy
*Assistant Examiner* — Nicholas D Wlodarski
(74) *Attorney, Agent, or Firm* — Xsensus, L.L.P.

(57) ABSTRACT

A system, apparatus, and method for leveling a borehole or blasthole drilling machine, or portion thereof, provided over a drilling site can implement a ground contact detect phase or operation, a first coarse leveling phase or operation, a lowering phase or operation, and a fine leveling phase or operation. The phases or operations can be based on or responsive to signals from sensors of the drilling machine. The phases or operations can involve changing length of one or more of the jacks of the drilling machine when the drilling machine is positioned over the drilling site.

20 Claims, 4 Drawing Sheets

(56) References Cited

U.S. PATENT DOCUMENTS

| | | | | |
|---|---|---|---|---|
| 5,188,379 | A * | 2/1993 | Krause | B60S 9/12 254/423 |
| 7,438,143 | B2 | 10/2008 | Law et al. | |
| 10,184,295 | B2 * | 1/2019 | Marek | E02F 9/2257 |
| 10,343,653 | B1 * | 7/2019 | Garceau | G01C 9/08 |
| 10,895,112 | B2 * | 1/2021 | Krelifaoui | E21B 7/024 |
| 2011/0112728 | A1 * | 5/2011 | Stacy, II | E02F 9/085 701/49 |
| 2017/0234119 | A1 * | 8/2017 | Allen | E21B 15/00 700/275 |
| 2019/0011933 | A1 | 1/2019 | Stacy, II | |

* cited by examiner

SYSTEM, APPARATUS, AND METHOD TO PERFORM LEVELING FOR BOREHOLE DRILLS

CROSS-REFERENCE TO RELATED APPLICATION(S)

This application claims the benefit under 35 U.S.C. § 119(e) of Provisional App. No. 62/873,700, filed Jul. 12, 2019, the content and disclosure of which is incorporated herein by reference in its entirety.

TECHNICAL FIELD

The present disclosure relates to automatic leveling, and more particularly to systems, apparatuses, and methods to automatically level borehole or blasthole drills positioned over a drill site for drilling.

BACKGROUND

For a drilling operation at a construction or mining site, such as a blasthole drilling operation, a drilling machine may generally follow an operating sequence involving: a propelling phase whereby the drilling machine is moved to a location where a hole is to be drilled; a leveling phase whereby the tracks, wheels, and/or wheel platforms of the drilling machine are raised off of the ground and the chassis of the drilling machine is leveled using jacks of the drilling machine, for instance, in order to drill a hole (e.g., vertical or inclined) at the desired location; a drilling phase whereby the drilling machine drills the hole; and a de-leveling phase whereby the drilling machine is returned to its state just prior to the leveling phase, including removing the drill bit from the hole and retracting the jacks such that the tracks, wheels, and/or wheel platforms are on the ground.

Some drilling machines may be fitted with an automatic leveling system. Such automatic leveling systems may avoid retracting or lowering one or more jacks (e.g., not lower any jacks) during the leveling phase in an effort to prevent loss of ground contact for the one or more jacks. Such systems may also use closed loop control using feedback from pitch and roll sensors of the drilling machine to control the jacks in an effort to achieve a desired level state. Filtering and a relatively slow response time of the pitch and roll sensors combined with relatively slow response time of the jacks may cause the automatic leveling system to overshoot the desired level state. Such tendency to overshoot, combined with the rule to not retract or lower one or more jacks, can result in continued oscillation of the leveling operation such that the jacks are extended more than is necessary (e.g., all jacks fully extended) or never achieve an acceptable level state.

Additionally, in a case where the drilling machine starts on very unlevel ground, the two-phase process of first lowering the jacks to ground and then leveling the drilling machine can mean that the jacks that were originally on the high side of the slope will be extended to the point where the tracks or wheels or wheel platforms on that side of the drilling machine will be higher than necessary off the ground. This can result in a less stable platform, as the jacks may be extended more than needed.

U.S. Pat. No. 4,679,489 ("the '489 patent") describes an automatic leveling system for blast hole drills and the like. In particular, the '489 patent describes a dual automatic leveling system for a blast hole drill during raising and lowering which includes "fine" level sensors to detect an attitude with a fine level range and "course" level sensors to detect an attitude outside a course level range which is greater than that of the first. According to the '489 patent, the "fine" level sensors will be used to initially level the drilling platform, where if during such raising or lowering the platform becomes out of level by a certain amount the "coarse" level sensors will cause the raising or lowering process to stop and a re-leveling to +/−0.5° is effected before a raising or lowering is continued.

SUMMARY OF THE DISCLOSURE

In one aspect, an automatic leveling system for a blasthole or borehole drilling machine is disclosed. The system can comprise a plurality of jacks; a plurality of sensors; and a controller configured to receive signals from the sensors and control the jacks to automatically level a drill assembly of the drilling machine. The control includes a ground contact detect phase, followed by a first coarse leveling phase, followed by a lowering phase, and a fine leveling phase after the lowering phase.

In another aspect, a method for leveling a borehole drilling machine provided over a drilling site is disclosed. The method can comprise performing, under control of or using control circuitry, a contact surface detection operation to determine when each of a plurality of jacks positioned relative to the borehole drilling machine makes contact with a contact surface underlying the borehole drilling machine; performing, under control of or using the control circuitry, a first coarse leveling operation, after the contact surface detection operation; performing, under control of or using the control circuitry, a lowering operation, after the contact surface detection operation; and performing, under control of or using the control circuitry, a fine leveling operation, after the contact surface detection operation. The performing the contact surface detection operation, the performing the first coarse leveling operation, the performing the lowering operation, and the performing the fine leveling operation each include changing length of one or more of the jacks when the borehole drilling machine is positioned over the drilling site. The performing the fine leveling operation levels a chassis of the borehole drilling machine to a predetermined levelness range.

Other features and aspects of this disclosure will be apparent from the following description and the accompanying drawings.

DETAILED DESCRIPTION

Embodiments of the disclosed subject matter involve automatic leveling, and more particularly systems, apparatuses, and methods to automatically level borehole or blasthole drills positioned over a drill site for drilling.

Figure 1:
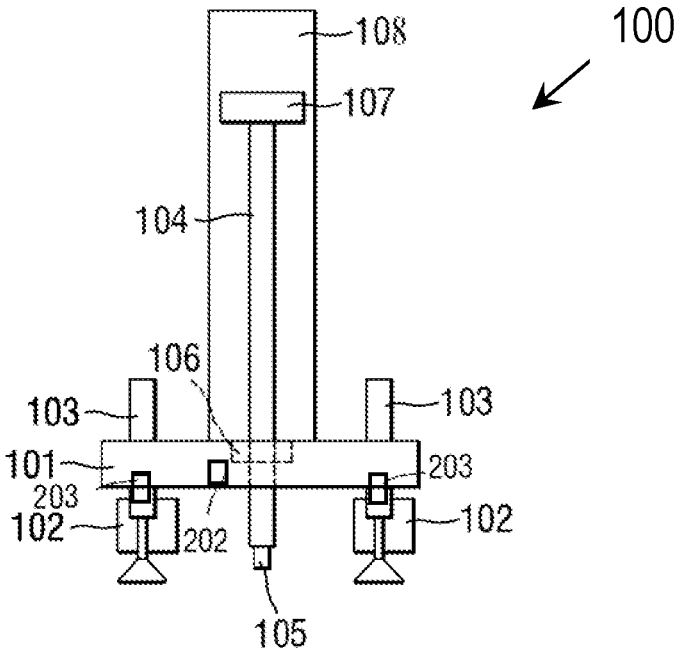
FIG. 1 is a diagrammatic end view of a drilling machine according to embodiments of the disclosed subject matter.

FIG. 1 is a diagrammatic end view of a drilling machine 100 according to embodiments of the disclosed subject matter. Generally, the drilling machine 100 can be used to drill a hole through material, such as rock. The hole may be referred to as a borehole or a blasthole, and may be filled with material (e.g., explosives) for the purpose of activating (e.g., detonating) the material within the hole.

The drilling machine 100 can be comprised of a chassis 101, to which a traction system is coupled. The chassis 101 may refer to a drill assembly or a portion of a drill assembly of the drilling machine 100. The traction system, according to embodiments of the disclosed subject matter, can be comprised of a set of tracks and/or a set of wheels or wheel platforms 102. The traction system may be used to move the drilling machine 100 to and from a drill site.

The drilling machine 100 can also include a drill string 104, which can be comprised of a drill bit 105 and other attachments; a deck bushing 106, which may be to guide the drill string 104; a rotary head 107, which may be to turn the drill string 104 and apply downward pressure; and a tower 108, which may be to attach the rotary head 107 to the chassis 101.

The drilling machine 100 can also have, or have associated therewith, a plurality of jacks 103, which may be referred to as leveling jacks 103. Generally, the jacks 103 can be controlled, by control system 200, which may be part of the drilling machine 100, to make the drilling machine 100, particularly the chassis 101 thereof, level prior to start of the drilling phase or operation. The jacks 103 may be individually and independently controlled, or, alternatively, controlled in pairs, for instance (e.g., front jacks 103 may be hydraulically coupled to equalize pressure). Jacks 103 may be positioned at corners or vertices of the chassis 101, for instance, such as pairs of corners of the chassis 101. For instance, in the case of a rectangular or square chassis 101, jacks 103 can be respectively provided at the four corners of the chassis 101.

Figure 2:
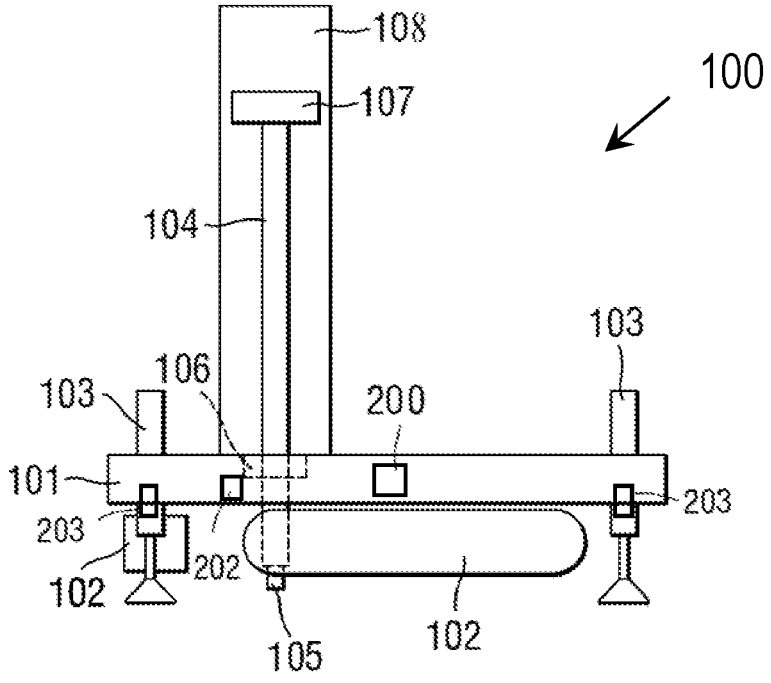
FIG. 2 is a diagrammatic side view of the drilling machine of FIG. 1.

The drilling machine 100 can also have a plurality of sensors, including one or a plurality of jack sensors 203 associated with each of the jacks 103 and an attitude sensor 202. The jack sensors 203 can sense or detect information pertaining to the jacks 103, such as position (e.g., amount of extension) and/or whether the jacks 103 have contacted a contact surface, such as ground, underlying the drilling machine 100, and send such information to the control system 200 (interconnections between control system 200 and jack sensors 203 not shown in FIG. 1 and FIG. 2. Discussed in more detail below, in certain phases or operations, the jack sensors 203 may constitute primary sensors and the attitude sensor 202 may constitute a secondary or auxiliary sensor.

Figure 3:
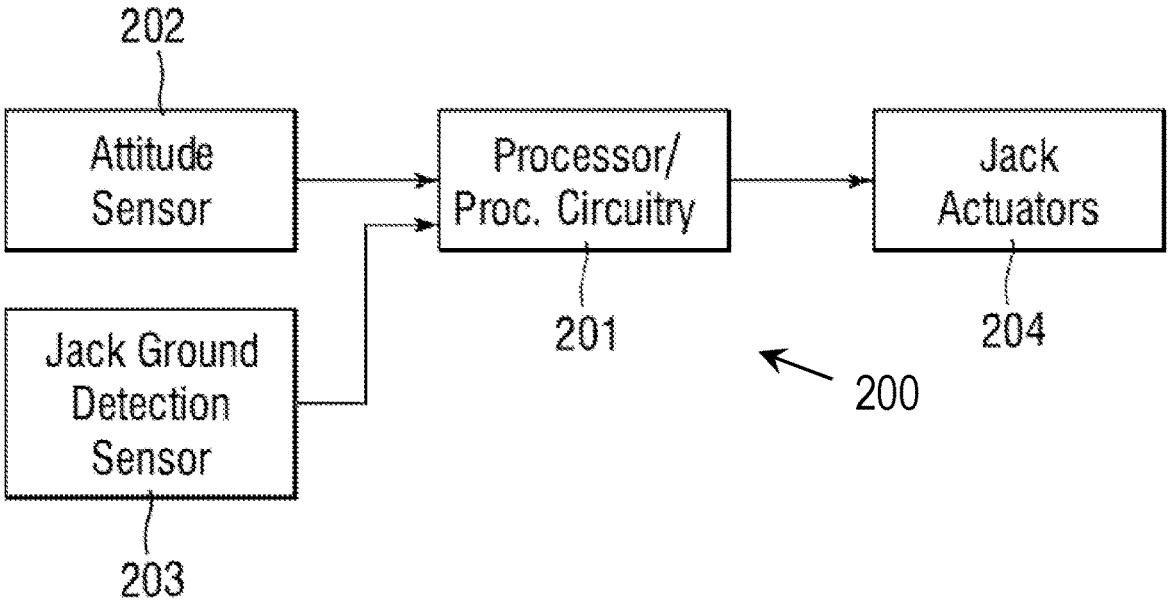
FIG. 3 is a block diagram of a control system for leveling the drilling machine of FIG. 1, according to embodiments of the disclosed subject matter.

As shown in FIG. 3, the jack sensor 203 can provide signals to a processor or processing circuitry 201 of a control system 200, according to embodiments of the disclosed subject matter. The processor or processing circuitry 201, which may include or be able to access electronically readable memory, may be referred to herein as a controller or control circuitry. Optionally, some or all of the control system 200 may be referred to as a controller or control circuitry.

FIG. 3, as an example, shows the jack sensors 203 in terms of contact surface detection sensors that determine when the jacks 103 have contacted the contact surface (e.g., ground). As a non-limiting example, jack sensors 203 in the form of contact surface detection sensors may be pressure sensors. For instance, jack sensors 203 may be hydraulic pressure sensors in the form of a switch in the jack 103 that sends a discrete (on/off) signal depending upon whether the hydraulic pressure in a given part of a jack cylinder exceeds a preset threshold or not.

Of course, jack sensors 203, according to embodiments of the disclosed subject matter, may also be representative of additional jack sensors to sense position-related information (e.g., amount of extension, speed of extension and/or retraction, etc.) of the jacks 103. Such jack sensors 203 can be provided within the jacks 103, for instance, within jack actuators 204 thereof, and/or outside the jacks 103. For instance, jack sensors 203 that can determine position of the jacks 103 and/or whether the jacks 103 contact the contact surface can be image sensors that capture images of the jacks 103. To be clear, jack sensors 203 can represent sensors adapted to determine whether the jacks 103 have contacted the contact surface and/or sensors adapted to determine position-related information (e.g., amount of extension, speed of extension and/or retraction, etc.) of the jacks 103.

The attitude sensor 202, generally, can sense an attitude, for instance, roll and/or pitch, of the drilling machine 100. According to one or more embodiments, the attitude sensor 202 can sense the roll and/or pitch of the chassis 101. The attitude sensor 202 or information therefrom can determine a level state or levelness of the drilling machine 100, particularly the chassis 101 thereof. As shown in FIG. 3, signals from the attitude sensor 202 can be sent to the processor or processing circuitry 201.

Figure 4:
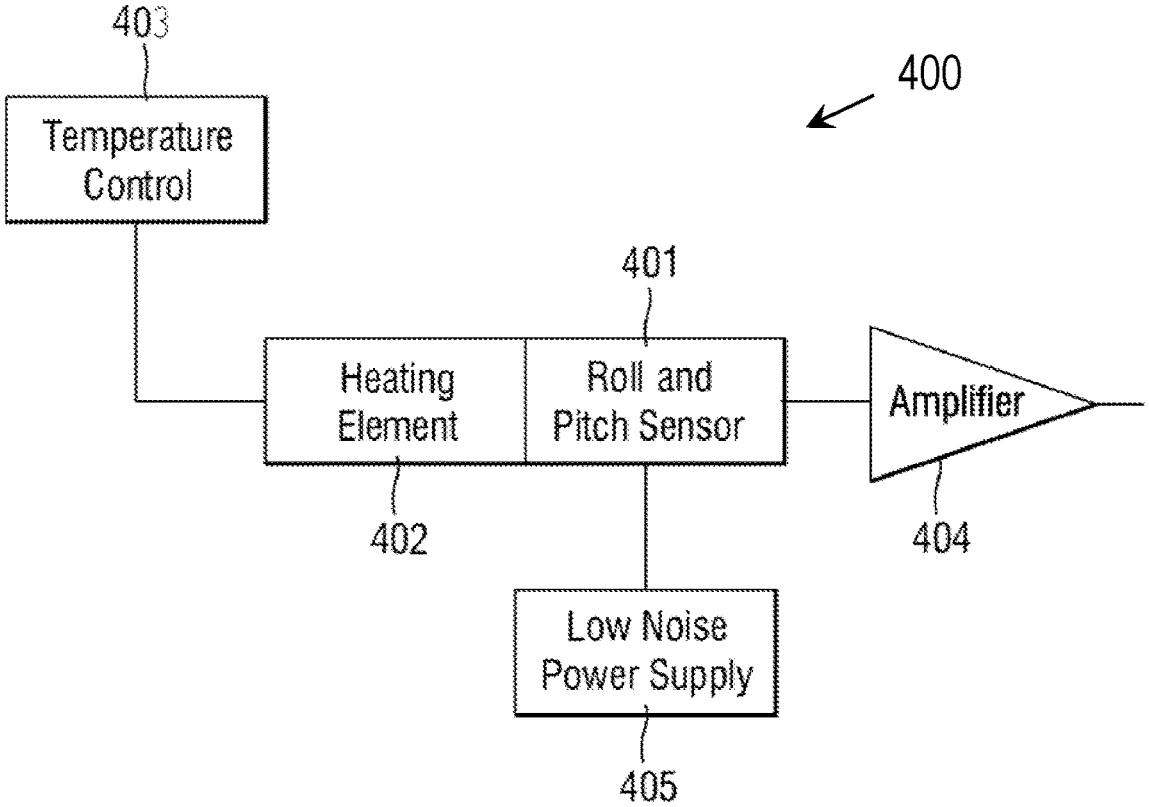
FIG. 4 is a block diagram of an attitude sensor or sensing circuitry according to embodiments of the disclosed subject matter.

FIG. 4 shows an example of the attitude sensor 202, according to embodiments of the disclosed subject matter, in the form of roll and pitch sensor circuitry 400. The pitch and roll sensor circuitry 400 of FIG. 4 can be adapted to measure pitch and roll of the drilling machine 100, for instance, the chassis 101 thereof. The pitch and roll sensor circuitry 400 can include a pitch and roll sensor 401, which may be or include one or more accelerometers, a heater 402, temperature control circuitry 403, an amplifier 404, and a power supply 405, which may be a low-noise power supply. The output of the roll and pitch sensor circuitry 400 may be provided to the processor or processing circuitry 201.

As noted above, the control system 200 can have processor or processing circuitry 201, which may be characterized or called a computing platform, that can processor signals from the attitude sensor 202 (or multiple attitude sensors 202) and the jack sensors 203. The processor or processing circuitry 201 can output control signals to control the jack actuators 204 based on the signals from the attitude sensor 202 and/or the jack sensors 203. Such control may be characterized as closed-loop control. The processor or processing circuitry 201 can also control the jack actuators 204 (and hence the lengths of the jacks 103) according to open-loop control, for instance, without use of signals from the attitude sensor 202 and/or the jack sensors 203.

As noted above, the control system 200 can control the jacks 103, by way of the jack actuators 204, to make the drilling machine 100, particularly the chassis 101 thereof, level prior to the start of the drilling phase or operation. Such leveling may be characterized as automatic, meaning that once the leveling process is initiated (e.g., responsive to a single input from an operator to initiate the leveling process), the process may proceed through the various phases or operations until the drilling machine 100 reaches a desired levelness target. Optionally, the jacks 103 can also be controlled during the drilling phase or operation to maintain the drilling machine 100 (e.g., the chassis 101 thereof) according to a particular level state or return the drilling machine 100 (e.g., the chassis 101 thereof) to the particular level state should the drilling machine 100 deviate outside of the particular level state. Such leveling may also be automatic, in this case, for instance, without the operator having to provide further inputs to maintain or correct the amount of levelness of the drilling machine 100. According to one or more embodiments, the leveling control to level the chassis 101 may be independent of the control for the drilling operation.

According to one or more embodiments, the particular level state may be a range of degrees for the chassis 101 relative to a plane, such as horizontal or a plane perpendicular to a drilling direction or axis of the drill string 104 and drill bit 105 of the drilling machine 100. For instance, the particular level state may be 0.1 degrees or less of horizontal or a plane perpendicular to a drilling direction or axis of the drill string 104 and drill bit 105 of the drilling machine 100 in a case where the drill string 104 and drill bit 105 are not exactly vertical. As another example, the particular level state may be less than 0.5 degrees of horizontal or a plane perpendicular to a drilling direction or axis of the drill string 104 and drill bit 105 of the drilling machine 100 in a case where the drill string 104 and drill bit 105 are not exactly vertical. Such leveling targets can be with respect to the x-axis and/or the y-axis.

Generally, the leveling prior to performing a drilling operation or phase can be performed when the drilling machine 100 is positioned over a drilling site and can include a ground contact detect phase or operation, a coarse leveling phase or operation, a lowering phase or operation, and a fine leveling phase or operation, using the control system 200. The fine leveling phase or operation can orient the drilling machine 100, particularly the chassis 101 or drilling assembly, for the drilling operation or phase. An option additional coarse leveling phase or operation may also be performed, for instance, between the lowering phase or operation and the fine leveling phase or operation. The foregoing phases or operations can involve changing length (e.g., lengthening or shortening) of one or more of the jacks 103. It logically follows that such changing can be preceded by determining whether the length of the jacks 103 needs to be changed.

INDUSTRIAL APPLICABILITY

As noted above, embodiments of the present disclosure relate to automatic leveling, and more particularly systems, apparatuses, and methods to automatically level borehole or blasthole drills, which may be referred to herein as drilling machines, such as drilling machine 100. Such automatic leveling can be performed once the drilling machine 100 is positioned over the desired drill hole location and prior to commencement of the drilling operation.

Hence, embodiments of the disclosed subject matter can provide an automatic leveling system and/or method utilizing a multi-step leveling process, wherein one or more of the steps may involve or implement machine learning operations. Leveling systems and/or methods according to embodiments of the disclosed subject matter can leverage a combination of closed loop control with so-call loose leveling targets and machine learning to overcome relatively highly filtered sensor signals and/or relatively slow jack 103 response times and minimize or avoid oscillations (e.g., overshoots) to achieve results in the fastest possible leveling time. Moreover, automatic leveling systems and/or methods according to embodiments of the disclosed subject matter may be used through the drilling phase, can adjust its responses automatically to the drilling machine on which it is installed, and can adapt to changing conditions of that particular drilling machine over time.

Automatic leveling systems and/or methods according to embodiments of the disclosed subject matter can bring a drilling machine, such as drilling machine 100, to a predetermined level state, such as an ideal level state. An ideal level state may be within a predetermined tolerance, such as 0.1 degrees or less from horizontal (or a plane perpendicular to a drilling direction of the drilling machine 100).

As noted above, leveling systems and methods according to embodiments of the disclosed subject matter can implement a ground detection step; an initial coarse leveling step; a lowering step; an optional coarse leveling step; and a fine leveling step to achieve and optionally maintain a state of level of the drilling machine 100. According to one or more embodiments, the leveling system and/or method can implement or perform steps, operations, or phases consisting of the foregoing steps, operations, or phases to level the drilling machine 100 (with or without the optional coarse leveling step).

The leveling systems and/or methods according to embodiments of the disclosed subject matter can implement multi-point interpolated instructed continuous machine learning, which can allow the control system 200 to adapt its operation to particularities of the drilling machine 100 under control and/or changing conditions in the operation of the drilling machine 100, such as fluctuations of ambient temperature, aging of components of the drilling machine 100, and/or changing or differing characteristics of the underlying contact surface of the drilling machine 100. In that leveling systems and/or methods according to embodiments of the disclosed subject matter can be used during the drilling operation, the control can be so as to actively compensate for ground sagging, jack sagging, and/or other situations that can cause the drilling machine 100 to become un-leveled during drilling.

Figure 5:
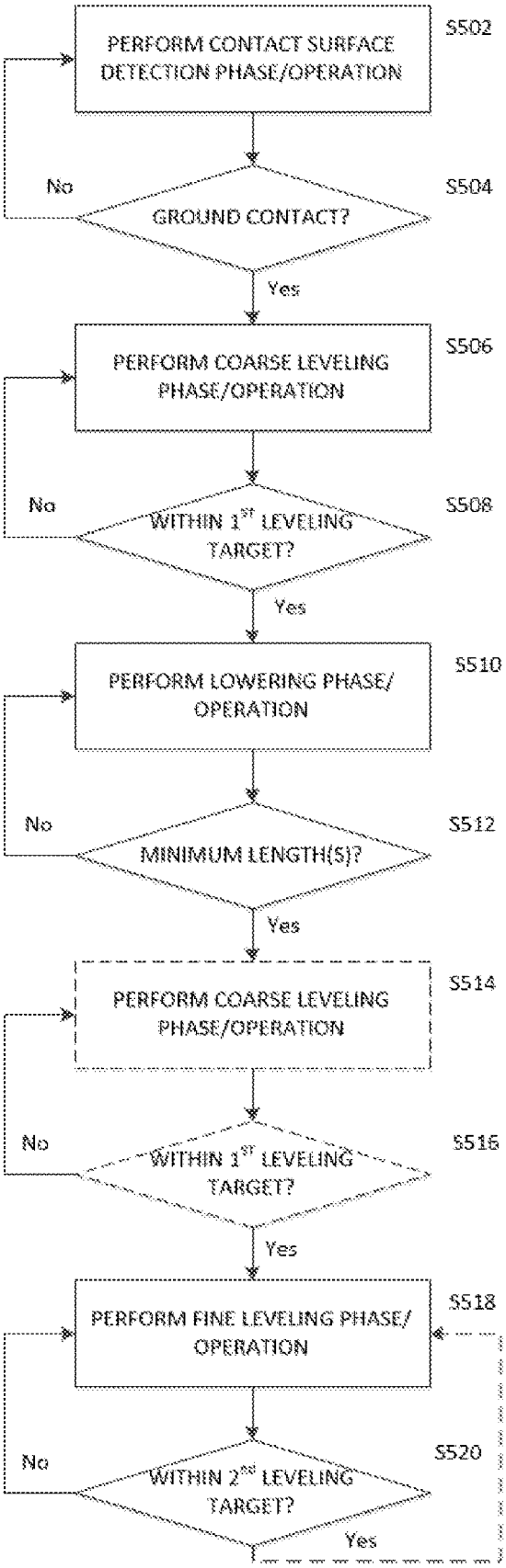
FIG. 5 is a flow diagram of a method according to embodiments of the disclosed subject matter.

FIG. 5 is a flow diagram of a method 500 according to embodiments of the disclosed subject matter. The method 500 can be performed by or under control of the control system 200, particularly the processor or processing circuitry 201 thereof. According to one or more embodiments, the method 500 can be implemented by or according to computer-readable instructions stored on a non-transitory computer-readable storage medium that, when executed by a computer, such as processor or processing circuitry 201, perform the method 500.

The method 500 may begin with the initiation of a leveling operation. As noted above, the leveling operation may begin when the drilling machine 100 is positioned over the desired drill hole location (and prior to commencement of the drilling operation). As noted above, the method 500 may be performed in its entirety in response to a single input from an operator to initiate the method 500, for instance, at a control interface (not shown) of or associated with the drilling machine 100.

At S502 the method 500 can implement a contact surface detection phase or operation. S502 can include detection of whether the jacks 103 are in contact with a contact surface underlying drilling machine 100. Such operation may also involve lowering or extending, i.e., changing a length of, one or more (e.g., all) of the jacks 103, under control of the control system 200, particularly the processor or processing circuitry 201 and the jack actuators 204, depending upon whether or not the jacks 103 are initially determined to be contacting the contact surface. Such lowering can be until the control system 200 determines that the jacks 103 have reached the contact surface. Optionally, according to one or more embodiments, the jacks 103 may be lowered simultaneously, though the jacks 103 may not all contact the contact surface at the same time, for instance, because of different elevations of the contact surface and/or different speeds of lowering the different jacks 103.

The lowering of the jacks 103 can raise the chassis 101, for instance, such that the track/wheel platform(s) of the traction system 102 are raised off of the contact surface. Optionally, the track/wheel platform(s) of the traction system 102 can be raised so as to be out of contact with the contact surface.

The detection of whether the jacks 103 contact the contact surface can be performed using feedback, i.e., signals from the jack sensors 203 and/or the attitude sensor 202. Such feedback may be characterized as closed-loop control. In the case of the attitude sensor 202, the attitude sensor 202 can send pitch and roll signals corresponding to movement of the drilling machine 100, for instance, the chassis 101, to the processor or processing circuitry 201. The processor or processing circuitry 201 can process the signals from the attitude sensor 202 to determine when each jack 103 contacts the contact surface. As an example, the detection of whether the jacks 103 contact the contact surface can be based on whether the height or level and/or levelness of the chassis 101 changes by a predetermined amount. For instance, the beginning of rising of a portion of the chassis 101 associated with one of the jacks 103 may cause the attitude sensor 202 to output signals indicative of the associated jack 103 contacting the contact surface (and hence causing the portion of the chassis 101 to rise).

Optionally, contact surface detection may be based on whether one or more of the jack sensors 203 has been previously found or is currently found to be unreliable (e.g., error state, failed, etc.). The jack sensors 203, therefore, may, in one or more embodiments, constitute a primary contact surface detection system, and the attitude sensor 202 may constitute a secondary or auxiliary contact surface detection system. For instance, in a case where one or more of the jack sensors 203 is determined to have failed, signals from the attitude sensor 202 can still be used by the processor or processing circuitry 201 to determine when the jack or jacks 103 associated with the failed jack sensor(s) 203 contacts the contact surface. Hence, according to embodiments, in the absence of dedicated jack sensors 203 in the form of contact surface contact sensors 203 (e.g., failure of one or more jack sensors 203) additional measurement and machine state information can be leveraged to determine contact surface contact of the jacks 103. Such machine state information can include a previously known state of the jack 103, a presumed state of the jack 103, agreement or conflict with other sensors, previous control commands for the jack 103 and/or timing information regarding control of the jack 103. On the other hand, if the jacks sensors 203 are deemed reliable (e.g., not determined to be failed), then the contact surface detection may be based on only the signals from the jack sensors 203 and not the attitude sensor 202.

Figure 6A:
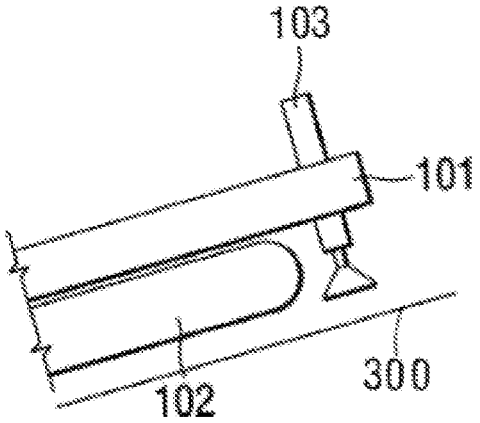
FIGS. 6A-6C are block diagrams of a drilling machine according to embodiments of the disclosed subject matter in various orientations.
Figure 6B:
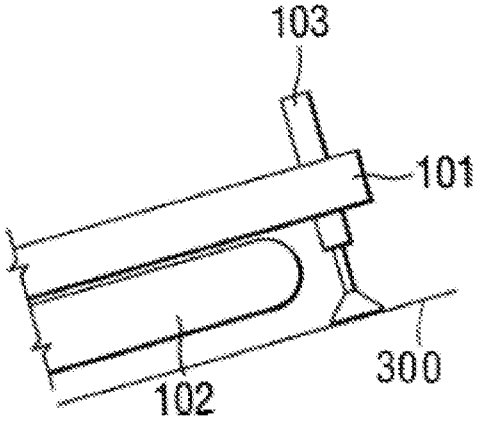

The method 500 may proceed at S504 back to S502 until contact with the contact surface has been determined for all of the jacks 103. When all of the jacks 103 have been determined to have contacted the contact surface, for instance, using the control system 200, the method can proceed to S506. FIG. 6A and FIG. 6B may be representative of a transition from initiation of the leveling operation (in FIG. 6A) to a state where the jacks 103 are determined to be in contact with the contact surface 300 (FIG. 6B, though noting that only one jack 103 is shown contacting the contact surface 300).

Operation or phase S506 of method 500 can involve a coarse leveling phase or operation at S506. Optionally, the coarse leveling phase or operation S506 may be a first of two coarse leveling phases or operations.

Generally, the coarse leveling phase or operation S506 can include changing length of one or more of the jacks 103, under control of the control system 200, for instance, so the drilling machine 100, particularly the chassis 101 or drill assembly, is within a first leveling target. The first leveling target may be range of degrees for the chassis 101 relative to a predetermined plane, such as horizontal or a plane that is perpendicular to a drilling direction of the drill string 104 and drill bit 105. Such first leveling target may be characterized as a loose leveling target, meaning that the leveling target is greater in range or tolerance than a range or tolerance of a leveling target associated with the fine leveling phase or operation S518 (discussed in more detail below). As a non-limiting example, the first leveling target may be 0.5 degrees or less relative to horizontal or a plane perpendicular to the drilling direction of the drill string 104 and drill bit 105. Such leveling target can be with respect to the x-axis and/or the y-axis.

Figure 6C:
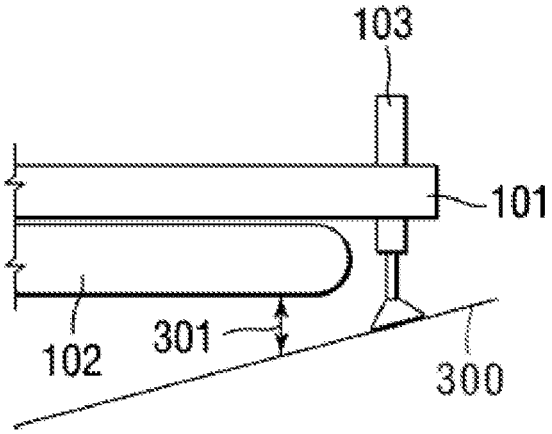

The coarse leveling phase or operation S506 can be characterized as a closed-loop feedback phase or operation, since the control of the level of the chassis 101 to the first leveling target can be based on signals from the attitude sensor 202 provided to the processor or processing circuitry 201 and the processor or processing circuitry 201 controlling the jack actuators 204 and hence the jacks 103 accordingly. Leveling the chassis 101 according to a so-called relatively loose leveling target can prevent the system from entering an oscillating state and therefore extending the jacks 103 by an unnecessary amount. FIG. 6C may be representative of the drilling machine 100, particularly showing the chassis 101, at the end of the coarse leveling phase or operation S506.

The method 500 may proceed at S508 back to S506 until contact with the chassis 101 has been leveled, by control of the jacks 103, to the first leveling target. Once the chassis 101 has been determined to be at or within the first leveling target, the method 500 can proceed to S510.

Notably FIG. 6C shows an example of starting from a significantly un-level state at the end of the coarse leveling phase or operation S506 can lead to excessive jack extension 301. This can result in a less stable platform, as one or more of the jacks 103 may be extended more than needed, giving the drilling energy more leverage on the longer than necessary jacks 103. To address this issue, embodiments of the disclosed subject matter can perform a lowering operation or phase at S510. Generally, the lowering phase or operation S510 can involve changing length, i.e., shortening, of one or more of the jacks 103 to respective minimum lengths while maintaining contact between the jacks 103 and the underlying contact surface 300. Optionally, such lowering of the jacks 103 may be such that the track/wheel platform(s) 102 of traction system remain out of contact with the contact surface 300.

The lowering operation or phase at S510 can be based on a determined speed of lowering the jacks 103, as determined using signals from the jack sensors 203 and/or the attitude sensor 202 and processed by the processor or processing circuitry 201, as well as an initial pitch angle of the drilling machine 100, particularly the chassis 101 thereof, and a priori knowledge of geometry of the drilling machine 100. The initial pitch angle may be with respect to the pitch angle of the drilling machine 100 prior to the contact surface detection phase or operation S502. Machine learning may be implemented, for instance, by the control system 200, to determine the speed of lowering of each of the jacks 103, which can be combined with the a priori knowledge of machine geometry of the drilling machine 100 as well as the initial pitch angle, to calculate the correct amounts of lowering to apply to the jacks 103 after the coarse leveling phase or operation S506. For instance, the processing may involve using the machine level before the coarse leveling relative to a measured distance between the jack 103 associated with a highest edge of the chassis 101 and a close tip of the corresponding track. If the calculated distance 301 between the track 102 and the ground plane 300 is greater than a predetermined threshold, the jack 103 can be lowered. The foregoing can allow the system to reduce the jack 103 extended length to a minimum, while still maintaining contact with the contact surface for all jacks 103.

The method 500 may proceed at S512 back to S510 until all of the jacks 103 have been controlled, under control of the control system 200, for instance, to their respective minimum lengths. Once all of the jacks 103 have been controlled to their minimum lengths, the method can proceed to either another coarse leveling phase or operation at S514 or a fine leveling phase or operation at S518.

The coarse leveling phase or operation at S514, hence, may be an optional phase or operation, and may be performed, for instance, if during the lowering phase or operation S510 the leveling state of the drilling machine 100 transitions from the leveling target of the coarse leveling phase or operation S506 to outside this leveling target. For instance, speed differences between the jacks 103 during the lowering phase or operation S510 may have caused the drilling machine 100 to be un-leveled outside the leveling target for the coarse leveling phase or operation S506. The coarse leveling phase or operation S514 may then be performed, and may be the same as the coarse leveling phase or operation S506, perhaps with the exception of the starting point for this particular phase/operation. In this regard, the leveling target may be the same as in the coarse leveling phase or operation S506. Alternatively, the leveling target may be different, for instance, between the leveling target of the coarse leveling phase or operation S506 and the leveling target for the fine leveling phase or operation S518 (discussed in more detail below). For instance, the leveling target for the coarse leveling phase or operation S514 may be 0.4 or less degrees from horizontal or a plane perpendicular to the drilling direction of the drilling machine 100. As noted above, leveling the chassis 101 according to a so-called relatively loose leveling target can prevent the system from entering an oscillating state (i.e., overshooting) and therefore extending the jacks 103 by an unnecessary amount.

The method 500 may proceed at S516 back to S514 until contact with the chassis 101 has been leveled, by control of the jacks 103, to the leveling target for the coarse leveling phase or operation S514. Once the chassis 101 has been determined to be at or within this leveling target, the method 500 can proceed to S518.

S518 can represent a fine leveling phase or operation, and can involve leveling the drilling machine 100, for instance, the chassis 101 thereof, to a leveling state or target that is more level than the leveling target(s) of the coarse leveling phase or operations S506, S514. For instance, the leveling target for the fine leveling phase or operation S518, which may be referred to herein as a second leveling target, may be 0.1 degrees or less relative to horizontal or a plane perpendicular to the drilling direction of the drilling machine 100. Such fine leveling target can be with respect to the x-axis and/or the y-axis.

The fine leveling phase or operation S518 may be performed according to open-loop control. This can mean that the control is performed without feedback from the attitude sensor 202 and/or the jack sensors 203. Open-loop control can be implemented to overcome overshoot and resulting oscillations (i.e., overshoots) that could otherwise be induced by the relatively slow response time of the attitude sensor 202 and the jack sensors 203, and the jacks 103.

The open-loop control, which may be performed by the processor or processing circuitry 201, may be according to multi-point interpolated instructed continuous machine learning. Such multi-point interpolated instructed continuous machine learning can be used to determine the amount of movement of each jack 103 to correct the state of level of the drilling machine 100. Generally, multi-point interpolated instructed continuous machine learning can mean interpolation made on a discrete function for which the image value for multiple points are continuously learned and updated by the machine (i.e., processor 201) itself, based on the constrained observation of results obtained upon actions taken in specific conditions. Put another way, the processing of the processor 201 (i.e., one or more algorithms) can learn what to do for a subset of reference conditions and interpolates for all conditions for which it has no specific knowledge. After each attempt to correct the state of level is executed, the control system 200 can measure performance and apply an immediate correction to the data point used in a multipoint list. Such control can prevent the system from diverging.

According to one or more embodiments, the fine leveling phase or operation S518 can constrain movement of a determined highest corner of the drilling machine 100 (e.g., the chassis 101) while the other corners are adjusted up or down to achieve the second leveling target. Such constrained control can involve preventing a determined highest jack 103 (and hence the highest corner of the chassis 101) from being moved in either direction. Such constrained control can also involve no constraints for the other jacks 103. According to one or more embodiments, the highest corner of the chassis 101 may correspond to the one of the jacks 103 that is extended the most relative to the other jacks 103.

The method 500 may proceed at S520 back to S518 until the levelness of the drilling machine satisfies the second leveling target for the fine leveling phase or operation S518. Such target may reach the point of attempting to make micro-adjustments (e.g., within portions of a degree, such as 0.05 degrees), where the process may be considered complete when the tentative adjustments are within a certain value. The threshold value for ending the fine leveling phase or operation S518 can be both configurable and dynamic. Generally, the level tolerance can be configurable, since the initial tolerance can be adjusted based on an operator's preferences regarding speed versus accuracy. And the level tolerance may be dynamic in that the tolerance can be automatically increased based on maximum time to achieve the target level, how much actual improvement is obtained on each adjustment, etc. The fine adjustment phase or operation S518 can bring the drilling machine 100 to a state of level that is appropriate for drilling operations.

After achieving the second leveling target at the fine adjustment phase or operation S518, drilling can commence. The method 500, however, can continuously monitor the levelness of the drilling machine 100 even during drilling operations and make adjustments to the level of the drilling machine 100. Such control can be based on feedback from the jack sensors 203 and/or the attitude sensor 202. Moreover, such control can maintain or return the levelness of the drilling machine 100 to within a predetermined leveling target, for instance, the second leveling target. Hence, as shown in FIG. 5, the method 500 may return control to perform the fine adjustment phase or operation S518 in the event that the levelness of the drilling machine 100 actually or is anticipated to deviate from the second leveling target. Likewise, in the event that the drilling machine 100 deviates more significantly, control may return to the coarse leveling phase or operation S514.

The continuously monitoring during drilling operations can apply corrections to maintain sufficient level if significant changes are observed. This phase can run continuously during the drilling phase to compensate for ground sagging, jack sagging, or other conditions that may result in the drilling machine 100 becoming un-level during the drilling process.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. An automatic leveling system for a blasthole or borehole drilling machine comprising: a plurality of jacks; a plurality of sensors; and a controller configured to receive signals from the sensors and control the plurality of jacks to automatically level a drill assembly of the drilling machine, wherein the control includes a ground contact detect phase, followed by a first coarse leveling phase, followed by a lowering phase, and a fine leveling phase after completion of the lowering phase, the fine leveling phase being performed prior to a drilling phase, wherein the lowering phase includes shortening of one or more of the plurality of jacks, and wherein the lowering phase includes shortening each of the plurality of jacks to respective minimum lengths.

2. The automatic leveling system according to claim 1, wherein the control further includes a second coarse leveling phase between the lowering phase and the fine leveling phase.

3. The automatic leveling system according to claim 2, wherein the second coarse leveling phase is performed when the lowering phase results in the drill assembly transitioning from within a first leveling target associated with the first coarse leveling phase to outside the first leveling target, the second coarse leveling phase bringing the drill assembly within the first leveling target, and wherein the first leveling target is within 0.5 degrees of horizontal.

4. The automatic leveling system according to claim 1, wherein the ground contact detect phase includes the controller receiving signals, from ground contact sensors, of the plurality of sensors, respectively associated with the jacks, indicative of when each of the jacks physically contacts underlying ground, as a primary ground contact detection system and/or signals from a pitch and roll sensor, of the plurality of sensors, of the drilling machine, indicative of when each of the jacks physically contacts the underlying ground, as an auxiliary ground contact detection system.

5. The automatic leveling system according to claim 1, wherein the first coarse leveling phase is a close-loop phase that levels the drill assembly according to a first leveling target that is less than a second leveling target associated with the fine leveling phase.

6. The automatic leveling system according to claim 1, wherein the lowering phase includes the shortening each of the jacks to respective minimum lengths while maintaining contact between the jacks and the underlying ground and while keeping each traction system of the drilling machine off the underlying ground.

7. The automatic leveling system according to claim 6, wherein the shortening of the jacks to respective minimum lengths is based on, for each of the jacks, a determined speed of lowering of the jack, initial pitch angle of the drilling machine prior to the ground contact detect phase, and geometry of the drilling machine.

8. The automatic leveling system according to claim 1, wherein the fine leveling phase is an open loop phase that levels the drill assembly according to a second leveling target that is less than a first leveling target associated with the first coarse leveling phase.

9. The automatic leveling system according to claim 8, wherein the second leveling target is within 0.1 degrees of horizontal.

10. The automatic leveling system according to claim 8, wherein the fine leveling phase implements multi-point interpolated instructed continuous machine learning to level the drill assembly according to the second leveling target.

11. The automatic leveling system according to claim 1, wherein the fine leveling phase prevents a highest jack of the plurality of jacks at the start of the fine leveling phase from moving up or down.

12. A method for leveling a borehole drilling machine provided over a drilling site comprising: performing, using control circuitry, a contact surface detection operation to determine when each of a plurality of jacks positioned relative to the borehole drilling machine contacts a contact surface underlying the borehole drilling machine; performing, using the control circuitry, a first coarse leveling operation, after the contact surface detection operation; performing, using the control circuitry, a lowering operation, after the contact surface detection operation; and performing, using the control circuitry, a fine leveling operation, after the contact surface detection operation and after the lowering operation, wherein said performing the contact surface detection operation, said performing the first coarse leveling operation, said performing the lowering operation, and said performing the fine leveling operation each include changing length of one or more of the plurality of jacks when the borehole drilling machine is positioned over the drilling site, wherein said performing the fine leveling operation levels a chassis of the borehole drilling machine to a predetermined levelness range, wherein said performing the fine leveling levels the borehole drilling machine to a second leveling target that is less than a first leveling target for said performing the first coarse leveling operation, and wherein said performing the lowering operation, which is performed prior to the fine leveling operation, includes shortening of one or more of the plurality of jacks and does not include any lengthening of any of the plurality of jacks and wherein the lowering phase includes shortening each of the plurality of jacks to respective minimum lengths.

13. The method according to claim 12, wherein said performing the contact surface detection operation, said performing the first coarse leveling operation, said performing the lowering operation, and said performing the fine leveling operation are performed in order responsive to a single input from an operator to initiate automatic leveling of the borehole drilling machine.

14. The method according to claim 12, further comprising, after said performing the fine leveling operation, continuously monitoring levelness of the borehole drilling machine and controlling one or more of the jacks to maintain the levelness of the borehole drilling machine within the predetermined levelness range.

15. The method according to claim 12, wherein the first coarse leveling operation is performed according to closed-loop control and the fine leveling operation is performed according to open-loop control.

16. The method according to claim 12, wherein the contact surface detection operation includes receiving signals, from contact surface sensors respectively associated with the jacks, indicative of when each of the jacks contacts the contact surface, as a primary contact detection system and/or signals, from pitch and roll circuitry of the borehole drilling machine, indicative of when each of the jacks contacts the contact surface, as an auxiliary contact detection system.

17. The method according to claim 12, wherein the lowering operation includes providing each of the jacks at respective minimum lengths while maintaining contact between the jacks and the contact surface and while maintaining lack of contact between each traction system of the borehole drilling machine and the contact surface, and wherein the lowering operation is based on, for each of the jacks, a determined speed of lowering of the jack and initial pitch angle of the borehole drilling machine prior to the contact surface detection operation.

18. The method according to claim 12, wherein the first coarse leveling operation levels the borehole drilling machine to 0.5 degrees or less of a plane perpendicular to a drilling direction of the borehole drilling machine, and wherein the fine leveling operation levels the borehole drilling machine to 0.1 degrees or less of the plane.

19. The method according to claim 12, wherein the fine leveling operation implements multi-point interpolated instructed continuous machine learning to level the borehole drilling machine.

20. The method according to claim 12, wherein the fine leveling operation includes constraining movement of only a highest corner of the borehole drilling machine while not constraining movement of all other corners of the borehole drilling machine.

* * * * *